US007307048B2

(12) United States Patent
Sagawa et al.

(10) Patent No.: US 7,307,048 B2
(45) Date of Patent: Dec. 11, 2007

(54) TRANSMISSION OIL COMPOSITION FOR AUTOMOBILE

(75) Inventors: Takumaru Sagawa, Yokohama (JP); Takafumi Ueno, Yokohama (JP); Hisayuki Wada, Yokosuka (JP); Tooru Aoki, Yokosuka (JP)

(73) Assignees: Nissan Motor Co., Ltd., Yokohama-Shi, Kanagawa (JP); Nippon Oil Corporation, Tokyo (JP)

( * ) Notice: Subject to any disclaimer, the term of this patent is extended or adjusted under 35 U.S.C. 154(b) by 496 days.

(21) Appl. No.: 10/479,299

(22) PCT Filed: May 28, 2002

(86) PCT No.: PCT/JP02/05139

§ 371 (c)(1),
(2), (4) Date: Feb. 11, 2004

(87) PCT Pub. No.: WO02/097017

PCT Pub. Date: Dec. 5, 2002

(65) Prior Publication Data

US 2004/0209786 A1 Oct. 21, 2004

(30) Foreign Application Priority Data

May 28, 2001 (JP) ..... 2001-158678

(51) Int. Cl.
*C10M 137/10* (2006.01)
*C10M 137/04* (2006.01)

(52) U.S. Cl. ..... 508/371; 508/421

(58) Field of Classification Search ..... 508/371, 508/421

See application file for complete search history.

(56) References Cited

U.S. PATENT DOCUMENTS

| | | | | |
|---|---|---|---|---|
| 4,983,313 | A * | 1/1991 | Kaneko et al. | 252/68 |
| 5,225,093 | A * | 7/1993 | Campbell et al. | 508/287 |
| 5,593,957 | A * | 1/1997 | Obara et al. | 508/501 |
| 6,096,692 | A * | 8/2000 | Hagihara et al. | 508/307 |
| 6,231,782 | B1 * | 5/2001 | Shimomura et al. | 252/68 |
| 6,831,045 | B2 * | 12/2004 | Shimomura et al. | 508/116 |

FOREIGN PATENT DOCUMENTS

| | | |
|---|---|---|
| EP | 0 534 735 A1 | 3/1993 |
| EP | 1 055 722 | 11/2000 |

OTHER PUBLICATIONS

Patent Abstracts of Japan; JP 5-32992 A (Mitsui Petrochemical Industries, Ltd.), Feb. 9, 1993.
Patent Abstracts of Japan; JP-8-302376 S (Mitsubushi Oil Co., Ltd.), Nov. 19, 1996.
Patent Abstracts of Japan; JP 2000-1687 A (Japan Energy Corp.), Jan. 7, 2000.
Patent Abstracts of Japan; JP 2000-109869 A (Nippon Mitsubishi Oil Corp.), Apr. 18, 2000.
European Search Report Dated Mar. 22, 2006; Application No. 02730726.3-2104.

* cited by examiner

*Primary Examiner*—Vasu Jagannathan
*Assistant Examiner*—Jim Goloboy
(74) *Attorney, Agent, or Firm*—Darby & Darby P.C.

(57) ABSTRACT

A transmission oil composition for an automobile characterized in that it contains a base oil selected from the group consisting of a mineral oil, a synthetic oil and mixtures thereof; and a phosphate compound selected from the group consisting of (A) a zinc dithiophosphate having a hydrocarbon group, (B) a triaryl phosphate (C) a triaryl thiophosphate, and mixtures thereof at 0.1 to 15.0% by mass with respect to the total composition; wherein the composition has a volume resistivity of $1\times10^7$ ohm·m or more at 80° C.

7 Claims, No Drawings

TRANSMISSION OIL COMPOSITION FOR AUTOMOBILE

FIELD OF ART

The present invention relates to a transmission oil composition for an automobile, and particularly to a transmission oil composition having excellent insulating ability, cooling ability and lubricity which is preferably used in an automobile equipped with an electric motor, such as an electric vehicle or a hybrid vehicle.

BACKGROUND ART

Recently, a transmission system for automobiles is required to have improved power transmitting efficiency, as well as a small size and a light weight for the demand of improved fuel efficiency of automobiles. The transmission mechanism may be manual or automatic, and recently some automobiles are equipped with a continuously variable transmission.

On the other hand, there has been developed an electric vehicle carrying a battery, such as a lead battery, a nickel-hydrogen battery, a lithium ion battery, and a fuel cell, and equipped with an electric motor, or a hybrid vehicle employing these batteries and an internal combustion engine in combination. In such vehicles, a transmission oil and an electric motor oil are used separately in each equipment.

It is now desired to develop an oil that can commonly be used in both the transmission and the electric motor and also desired to develop a packed system of such equipment for making electric vehicles and hybrid vehicles smaller and lighter. Therefore, it is now desired to produce an oil having insulating ability and cooling ability as an electric motor oil, in addition to lubricity as an oil for a manual transmission, an automatic transmission or a continuously variable transmission.

A transmission oil is desired to have stability against heat and oxidization, detergency-dispersancy ability, anti-wear ability, and anti-seizure ability. In order to fulfill such requirements, a transmission oil in general contains a base oil such as a mineral oil or a synthetic oil, and a variety of additives such as anti-oxidants, detergents/dispersants, anti-wear agents, rust inhibitors, metal deactivators, friction modifiers, antifoam agents, coloring agents, seal swellers, and viscosity index improvers. Such a transmission oil has low volume resistivity and insufficient insulating ability. Therefore if such an oil is used in an electric motor, that would result in troubles such as short circuit of the electric motor, insufficient cooling due to its high kinematic viscosity, and power loss upon transmitting.

On the other hand, an electric motor oil is desired to have insulating ability and cooling ability, whereas it does not need to have lubricity. Therefore the electric motor oil contains almost no additive. Employment of such an electric motor oil in the transmission system would result in severe seizure or wear trouble of bearings and gears.

That is, there has existed no transmission oil composition that has the anti-seizure and anti-wear ability as a transmission oil, as well as the insulating ability and cooling ability for automobiles especially such as the electric vehicles and hybrid vehicles equipped with the electric motor.

DISCLOSURE OF THE INVENTION

The objective of the present invention is to provide a transmission oil composition for an automobile which is useful as an oil for a transmission system and/or an electric motor of an electric vehicle or a hybrid vehicle, or an oil for a packaged device including the transmission system and the electric motor, i.e., a device in which the transmission system and the electric motor share a common lubrication system, wherein the oil composition has excellent anti-seizure ability as well as insulating ability and cooling ability.

For solving the aforementioned task, the present inventors have made extensive researches and found out that a composition having a specific phosphate compound has excellent anti-seizure ability as well as sufficient insulating ability and other abilities, to complete the present invention.

That is, according to the present invention, there is provided a transmission oil composition for an automobile comprising a base oil selected from the group consisting of a mineral oil, a synthetic oil and mixtures thereof; and 0.1 to 15.0% by mass with respect to the total composition of a phosphate compound selected from the group consisting of (A) a zinc dithiophosphate having a hydrocarbon group, (B) a triaryl phosphate, (C) a triaryl thiophosphate, and mixtures thereof; wherein said composition has volume resistivity of $1\times10^7$ ohm·m or more at 80° C.

EMBODIMENTS OF THE INVENTION

The transmission oil composition for the automobile of the present invention contains, as a base oil, a mineral oil, a synthetic oil or a combined oil thereof.

Examples of the mineral oil may specifically include a solvent or lubricant made of a paraffin or naphthene, and a normal paraffin, prepared by distilling a crude oil under atmospheric or reduced pressure to obtain a fraction, and purifying the fraction by any suitable combination of the treatments including solvent deasphalting, solvent extraction, hydrocracking, solvent dewaxing, contact dewaxing, hydrofining, washing with sulfuric acid, and clay purification. The mineral oil may preferably be those produced by removing or isomerizing basic nitrogen-containing compounds, sulfur compounds, polycyclic aromatic components, resin components, oxygen-containing compounds and the like by the solvent purification or hydrofining purification followed by removal of waxes for improving fluidity at a low temperature, and removal of water. High purity results in the transmission oil composition for the automobile having high stability against oxidization, and high volume resistivity. In the purification process of the mineral oil, employment of the clay purification and sulfuric acid purification results in the base oil having an extremely high insulating ability, although the mineral oil without such treatment is preferable in terms of cost and the problem of waste disposal.

Examples of the synthetic oil may include without limitation synthetic lubricant oils such as a poly-alpha-olefin (such as 1-octene oligomer, 1-decene oligomer and ethylene-propylene oligomer), a hydride thereof, an isobutene oligomer and a hydride thereof, an isoparaffin, an alkylbenzene, an alkylnaphthalene, an alkyldiphenylethane, monoisopropylbiphenyl, a dimethylsilicon, a diester (such as di-tridecyl glutarate, di-2-ethylhexyl adipate, di-isodecyl adipate, di-tridecyl adipate and di-2-ethylhexyl sebacate), a polyol ester (such as trimethylolpropane caprylate, trimethylolpropane pelargonate, pentaerythritol 2-ethylhexanoate, and pentaerythritol pelargonate), a polyoxyalkylene glycol, a dialkyldiphenyl ether, and a polyphenyl ether, as well as mixtures thereof. Among the synthetic oils, the poly-alpha-olefin and the hydride thereof, the isobutene oligomer and the hydride thereof, the isoparaffine, the alkylbenzene, the alkylnaphthalene, the alkyldiphenyl ethane, monoisopropyl biphenyl and the dimethylsilicon exhibit the volume resistivity of about $1\times10^{13}$ ohm·m or more at 80° C., and may preferably be used for obtaining excellent insulating ability of the composition. The ester compounds in general have the volume resistivity of about $1\times10^{9}$ to $1\times10^{13}$ ohm·m at 80° C., and are preferably subjected to complete removal of remaining water and impurities.

In the present invention, the synthetic oil may preferably be selected from the group consisting of the poly-alpha-olefin, the hydride thereof, the alkylbenzene, the ester compounds and mixtures thereof, for maintaining an optimal balance of fluidity at a low temperature and low volatility at the conditions for use.

As used herein, the volume resistivity at 80° C. refers to the one measured in accordance with JIS C 2101-24. (volume resistivity test).

The viscosity index of these base oils may preferably be 80 or more, and more preferably 100 or more, although not limited thereto.

There is no limitation as to the kinematic viscosity of these base oils. The base oil may be selected from the aforementioned mineral oils and synthetic oils having the kinematic viscosity of 1 to 100 $mm^2/s$ at 80° C. The base oil consisting of one sort of the oil or the mixture thereof may desirably have the kinematic viscosity of 1.5 to 15 $mm^2/s$, preferably 1.5 to 8.0 $mm^2/s$, and more preferably 1.5 to 4.0 $mm^2/s$, at 80° C.

The transmission oil composition for the automobile of the present invention contains a phosphate compound selected from the group consisting of (A) a zinc dithiophosphate having a hydrocarbon group, (B) a triaryl phosphate (C) a triaryl thiophosphate, and mixtures thereof. The present oil composition may further contain (D) an ashless dispersant in addition to the components (A) to (C).

The component (A) may preferably be a compound having a hydrocarbon group of 2 to 30, and preferably 3 to 20 carbon atoms.

Examples of the hydrocarbon group of 2 to 30 carbon atoms may specifically include an alkyl group such as ethyl, propyl, butyl, pentyl, hexyl, heptyl, octyl, nonyl, decyl, undecyl, dodecyl, tridecyl, tetradecyl, pentadecyl, hexadecyl, heptadecyl and octadecyl groups (these alkyl groups may be straight or branched); an alkenyl group such as butenyl, pentenyl, hexenyl, heptenyl, octenyl, nonenyl, decenyl, undecenyl, dodecenyl, tridecenyl, tetradecenyl, pentadecenyl, hexadecenyl, heptadecenyl and octadecenyl groups (these alkenyl groups may be straight or branched, and the double bond therein may be at any position); a cycloalkyl group having 5 to 7 carbon atoms such as cyclopentyl, cyclohexyl, and cycloheptyl groups; an alkylcycloalkyl group having 6 to 11 carbon atoms such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups (the alkyl substitution on the cycloalkyl group may be at any position); an aryl group such as phenyl and naphthyl groups; an alkylaryl group having 7 to 18 carbon atoms such as tolyl, xylyl, ethylphenyl, propylphenyl, butylphenyl, pentylphenyl, hexylphenyl, heptylphenyl, octylphenyl, nonylphenyl, decylphenyl, undecylphenyl and dodecylphenyl groups (the alkyl group therein may be straight or branched, and the alkyl substitution on the aryl group may be at any position); and an arylalkyl group having 7 to 12 carbon atoms such as benzyl, phenylethyl, phenylpropyl, phenylbutyl, phenylpentyl, and phenylhexyl groups (these alkyl groups may be straight or branched).

Examples of the preferable compound as the component (A) may specifically include a zinc dialkyldithiophosphate such as zincdipropyldithiophosphate, zincdibutyldithiophosphate, zinc dipentyldithiophosphate, zinc dihexyldithiophosphate, zinc diheptyldithiophosphate, and zinc dioctyldithiophosphate. The alkyl group of these zinc dialkyldithiophosphates may be straight or branched, and may preferably be the primary or secondary alkyl group. The primary alkyl group is preferably employed since it has excellent ability for preventing wearing of gear wheels and it does not reduce the volume resistivity.

The lower limit of the content of the component (A) in the transmission oil composition for the automobile of the present invention may be 0.1% by mass, preferably 0.5% by mass, and more preferably 1.2% by mass, with respect to the total amount of the composition. The upper limit of the content of the component (A) is 15.0% by mass, preferably 10.0% by mass, more preferably 4.0% by mass, and particularly preferably 3.0% by mass, with respect to the total amount of the composition. The anti-seizure property may be improved if the content of the component (A) is the same or greater than the aforementioned lower limit, whereas the insulating property may be maintained and generation of sludge may be suppressed if the content of the component (A) is the same or lower than the aforementioned upper limit.

The triaryl phosphate, the component (B), may have aryl groups without any substituent, or may have aryl groups with a substituent such as an alkylaryl group and an alkenylaryl group. Examples of the triaryl phosphate may specifically include those having an aryl group such as phenyl and naphthyl group; and those having an alkylaryl or alkenylaryl group having 7 to 18 carbon atoms such as tolyl, ethylphenyl, propylphenyl, butylphenyl, pentylphenyl, hexylphenyl, heptylphenyl, octylphenyl, nonylphenyl, decylphenyl, undecylphenyl, dodecylphenyl, xylyl, methylethylphenyl, diethylphenyl, methylpropylphenyl, dipropylphenyl, trimethylphenyl, dimethylethylphenyl, diethylmethylphenyl, triethylphenyl, etenylphenyl and propenylphenyl groups (the alkyl or alkenyl group may be straight or branched; any number of substitution on a aryl group may be present; and the substitution may be at any position.).

Examples of the preferable compounds as the component (B) may specifically include triphenyl phosphate, tritolyl phosphate (tricresyl phosphate), trixylyl phosphate, tri(ethylphenyl) phosphate, tri(propylphenyl) phosphate, and tri (butylphenyl) phosphate.

The lower limit of the content of the component (B) in the transmission oil composition for the automobile of the present invention may be 0.1% by mass, and preferably 0.2% by mass with respect to the total amount of the composition. The upper limit is 15.0% by mass, preferably 2.0% by mass, and more preferably 1.0% by mass, with respect to the total amount of the composition. The anti-seizure ability and anti-wear ability may be improved if the content of the component (B) is the same or greater than the aforementioned lower limit, where as the insulating property may be maintained and precipitation may be suppressed if the content of the component (B) is the same or lower than the aforementioned upper limit.

The component (C) is the triaryl thiophosphate. The triaryl thiophosphate may have aryl groups without any substituent, or may have aryl groups with a substituent.

Examples of the triaryl thiophosphate may specifically include those having any of a variety of aryl groups, alkylaryl groups and alkenylaryl groups enumerated in the above as those which the triaryl phosphates of the component (B) has.

Examples of the compound as the component (C) may specifically include triphenyl thiophosphate, tritolyl thiophosphate (tricresylthiophosphate), trixylylthiophosphate, tri(ethylphenyl) thiophosphate, tri(prophylphenyl) thiophosphate, and tri(butylphenyl) thiophosphate.

The lower limit of the content of the component (C) in the transmission oil composition for the automobile of the present invention may be 0.1% by mass, and preferably 0.4% by mass with respect to the total amount of the composition. The upper limit is 15.0% by mass, preferably 2.0% by mass, and more preferably 1.5% by mass, with respect to the total amount of the composition. The anti-seizure ability and anti-wear ability may be improved if the content of the component (C) is the same or greater than the aforementioned lower limit, whereas the insulating property may be maintained and precipitation may be suppressed if the content of the component (C) is the same or lower than the aforementioned upper limit.

The lower limit of the content of the phosphate compound selected from the group consisting of the components (A) to (C) and the mixtures thereof in the transmission oil composition for the automobile of the present invention may be 0.1% by mass, and preferably 0.5% by mass with respect to the total amount of the composition. The upper limit is 15.0% by mass, preferably 10.0% by mass, more preferably 6.0% by mass, and the most preferably 4.0% by mass, with respect to the total amount of the composition. The total content of the components (A) to (C) being lower than the aforementioned lower limit results in inferior anti-seizure ability and anti-wear ability. The total content of the components (A) to (C) being greater than the aforementioned upper limit results in inferior insulating ability, and may result in occurrence of precipitation.

The transmission oil composition for the automobile which contains the components (B) and/or (C) of the aforementioned components (A) to (C) as requisite component (s) may have better anti-wear ability.

The component (D) which the transmission oil composition for the automobile of the present invention may contain is the ashless dispersant. The component (D) exhibits excellent anti-wear ability when co-used with the aforementioned phosphate compound. Particularly, when co-used with the component (A), the component (D) may significantly improve the anti-wear ability, compared to the composition containing the component (A) without the component (D).

Examples of the component (D), the ashless dispersant, may include a nitrogen-containing compound having in its molecule at least one alkyl or alkenyl group having 12 to 400 carbon atoms, a derivative thereof, and a modified product of an alkenyl succinimide.

The alkyl or alkenyl group may be straight or branched, and may preferably be a branched alkyl group or a branched alkenyl group derived from oligomers of olefins such as propylene, 1-butene and isobutylene, and co-oligomers of ethylene and propylene.

The lower limit of the number average molecular weight of the alkyl or alkenyl group may be 150, and preferably 800, whereas the upper limit may be preferably 5000, more preferably 2000, and the most preferably 1200.

Examples of the derivative of the nitrogen-containing compound that was mentioned above as an example of the ashless dispersant may specifically be a so-called acid-modified compound obtained by reacting a nitrogen-containing compound such as those mentioned above with a monocarboxylic acid (fatty acid) having 2 to 30 carbon atoms or a polycarboxylic acid having 2 to 30 carbon atoms, such as oxalic acid, phthalic acid, trimellitic acid and pyromellitic acid, to partially or completely neutralize or amidize the remaining amino and/or imino groups; a so-called boron-modified compound obtained by reacting a nitrogen-containing compound such as those mentioned above with a boron compound such as boric acid or borate to partially or completely neutralize or amidize the remaining amino and/or imino groups; a sulfur-modified compound obtained by reacting a nitrogen-containing compound such as those mentioned above with a sulfur compound; and a modified product obtained by subjecting a nitrogen-containing compound such as those mentioned above to a combination of two or more of the modification processes selected from acid modification, boron modification and sulfur modification.

If the boron-containing ashless dispersant is employed as the component (D), the boron content in the component (D) may usually be 0.1 to 10% by mass. The boron content may preferably be 0.2 to 6% by mass, particularly 0.6 to 3% by mass in terms of obtaining good anti-wear ability.

The content of the component (D) in the transmission oil composition for the automobile of the present invention is not particularly limited provided that the volume resistivity at 80° C. of the composition suffices the definition of the present invention. The lower limit thereof may usually be 0.01% by mass with respect to the total composition. Desirably, the lower limit may be 10 ppm by mass and particularly 60 ppm by mass, in terms of nitrogen atom. The upper limit may be 10% by mass. Desirably, the upper limit may be 2000 ppm by mass, more preferably 400 ppm by mass and particularly 180 ppm by mass, in terms of nitrogen atom. Excellent anti-wear ability may be obtained if the content of the component (D) is the same or greater than the aforementioned lower limit, whereas excellent insulating ability may be obtained if the content of the component (D) is the same or lower than the aforementioned upper limit.

The volume resistivity of the transmission oil composition for the automobile of the present invention at 80° C. has to be $1\times10^7$ ohm·m or more, and may preferably be $1\times10^8$ ohm·m or more, more preferably $5\times10^8$ ohm·m or more, and particularly preferably $1\times10^9$ ohm·m or more. By setting the volume resistivity at 80° C. to not less than the aforementioned lower limit, good insulating ability may be obtained not only when the beginning of use of the oil composition, but also when the oil composition is degraded, by which troubles such as short circuit of the electric motor may be avoided for a long period of time.

The transmission oil composition for the automobile of the present invention may be a composition essentially consisting of the base oil which is the mineral oil, the synthetic oil or the mixture thereof, and the phosphate compound selected from the group consisting of the aforementioned components (A) to (C) and mixtures thereof; or may be a composition essentially consisting of the base oil, the phosphate compound and the aforementioned component (D). However, the present composition may further contain any of publicly known additives for lubricant oils for maintaining basic properties of a lubricant oil, such as a manual transmission oil, an automatic transmission oil, or a continuously variable transmission oil. Such additives may include a metal detergent, an extreme pressure agent and an anti-wear agent other than the aforementioned components (A) to (C), an antioxidant, a viscosity index improver, a rust inhibitor, an anti-static agent, a corrosion inhibitor, a pour point depressant, a rubber or seal sweller, an antifoam agent and a coloring agent. The additive(s) may be added solely or in combination. There is no limitation of the adding amount provided that the insulating ability of the transmission oil composition for the automobile of the present invention is not deteriorated.

Examples of the metal detergent may include, e.g., an alkaline earth metal sulfonate or phenate, and an alkaline earth metal salicylate. The alkaline earth metal may preferably be magnesium or calcium, more preferably calcium. As the metal detergent, those having the total base number of 0 to 500 mg KOH/g, and preferably 0 to 400 mg KOH/g may suitably be selected. If necessary, a plurality of species of the metal detergent may be used as a mixture. Since the metal detergent may significantly reduce the volume resistivity of the composition, it may preferably be used in a range of amount whereby the volume resistivity of the composition does not become less than $1\times10^7$ ohm·m, and preferably $5\times10^8$ ohm·m. For example, if a base oil having the volume resistivity of about $1\times10^{11}$ ohm·m at 80° C. is employed, the content of the metal detergent may be 1% by mass or less, and preferably 0.1% by mass or less with respect to the total amount of the composition, although it depends on the amount of other additives.

As the extreme pressure additive and anti-wear agent other than the components (A) to (C), e.g., a sulfur compound and a phosphate compound may be used. The sulfur compound may be, e.g., disulfide compounds, sulfidized olefins, sulfidized oils and fats, and sulfidized esters. The phosphate compound may be, e.g., phosphate monoesters, phosphate diesters, phosphate triesters, phosphite monoesters, phosphite diesters, and phosphite triesters, as well as amine salt or alkanol amine salt of these esters. These additives tend to lower the volume resistivity unlike the components (A) to (C), although the lowering is less significant than the metal detergent. The content of these additives must thus be determined carefully as the metal detergents, and may be used so that the volume resistivity does not become less than $1\times10^7$ ohm·m, preferably $5\times10^8$ ohm·m.

The antioxidant may be any of those generally used in lubricant oils such as phenol compounds and amine compounds. For example, alkyl phenols such as 2,6-di-tert-butyl-4-methylphenol, bisphenols such as 4,4-methylene-bis (2,6-di-tert-butyl-4-methylphenol), naphthylamines such as phenyl-alpha-naphthylamine, ester-containing phenols, dialkyldiphenylamines, phenothiazines, esters of (3,5-di-tert-butyl-4-hydroxyphenyl) fatty acid (such as propionic acid) and monovalent or polyvalent alcohols, such as methanol, octadecanol, 1,6-hexadiol, neopentyl glycol, thio diethylene glycol, triethylene glycol and pentaerythritol may be used. Among these, amine antioxidants such as phenyl-alpha-naphthylamine is preferred.

The viscosity index improver may be olefin copolymers of dispersant or non-dispersant type, polymethacrylates of dispersant or non-dispersant type, and mixtures thereof.

The rust inhibitors may be alkenyl succinic acid, esters of alkenyl succinic acid, polyalcohol esters, petrol sulfonate, and dinonylnaphthalene sulfonate.

The anti-static agent that can also be used as the corrosion inhibitor may be compounds of benzotriazols, thiazols, thiadiazoles, and imidazols. Benzotriazol compounds are preferred.

As the pour point depressant, polymers of polymethacrylates suitable for the base oil employed may be used.

As the antifoam agent, silicon compounds such as dimethylsiloxane, phenylmethylsiloxane, and cyclic organosiloxanes may be used.

The adding amount of these additives may optionally be adjusted. Usually, the adding amount of the antifoam agent may approximately be 0.0005 to 0.01% by mass, the viscosity index improver 0.01 to 20% by mass, the corrosion inhibitor 0.005 to 0.2% by mass, and other additives 0.005 to 10% by mass, with respect to the total amount of the composition. These may be added in the range of amount whereby the volume resistivity of the composition does not become less than $1\times10^7$ ohm·m, and preferably $5\times10^8$ ohm·m.

It is preferable that the transmission oil composition for the automobile of the present invention has the kinematic viscosity at 80° C. of 1.5 to 15 $mm^2/s$, preferably 1.5 to 8.0 $mm^2/s$, and more preferably 1.5 to 4.0 $mm^2/s$. The resulting composition may obtain excellent anti-seizure ability and anti-wear ability by setting the kinematic viscosity at 80° C. to not less than 1.5 $mm^2/s$, whereas the resulting composition may obtain excellent cooling ability and reduce the power loss of the electric motor by setting the kinematic viscosity to not more than 15 $mm^2/s$. The composition having such kinematic viscosity may be produced by adjusting the kinematic viscosity and mixing ratio of the base oil. Considering the capability of cooling the electric motor, it is preferable that the composition contains 10 to 90% by mass, preferably 20 to 80% by mass of the mineral oil and/or the synthetic oil having the kinematic viscosity of 1.0 to 6.0 $mm^2/s$, preferably 2.0 to 5.0 $mm^2/s$ at 40° C., to adjust the kinematic viscosity of the resulting composition at 80° C. to 1.5 to 3.5 $mm^2/s$.

The transmission oil composition for the automobile of the present invention may be produced without limitation by mixing the aforementioned base oil and additives.

If the transmission oil composition for the automobile of the present invention contains water or impurities, that may decrease the volume resistivity of the composition. It is thus desirable to prepare the composition containing small amount of waters and impurities using additives that is free from these undesirable matters. Specifically, the water content in the composition may preferably be not more than 1000 ppm by mass, more preferably not more than 100 ppm by mass, and particularly preferably not more than 50 ppm by mass.

The transmission oil composition for the automobile of the present invention has excellent anti-seizure ability, as well as excellent insulating ability and cooling ability. Particularly, the present composition may be used in an automobile equipped with an electric motor such as an electric vehicle or a hybrid vehicle, as a novel lubricant oil such as a transmission oil, an electric motor oil, an oil commonly used in the transmission system and the electric motor, a packaged device including the transmission system and the electric motor, i.e., a device in which the transmission system and the electric motor share a common lubrication system.

Particularly, if the transmission oil composition for the automobile of the present invention requisitely contains the component (B) and/or (C), or requisitely contains the ashless dispersant (D), the composition has, in addition to the aforementioned abilities, further excellent anti-wear ability, thus being a particularly excellent lubricant oil.

The present invention also provides a transmission system, an electric motor, and devices containing the transmission oil composition for the automobile of the present invention, as well as methods for lubricating, insulating and cooling of the transmission system, the electric motor and the devices using the transmission oil composition for the automobile of the present invention.

EXAMPLES

The present invention will be explained in more detail with reference to Examples and Comparative Examples, but the present invention is not limited thereto. The abilities of the composition of the present invention were evaluated by the evaluation test as described below.

(Volume Resistivity)

The volume resistivity of the composition was measured in accordance with JIS C 2101-24 (Volume Resistivity Test) at the oil temperature of 80° C.

(Kinematic Viscosity)

The kinematic viscosity was measured in accordance with JIS K 2283 at 40° C. and 100° C., and the kinematic viscosity at 80° C. was calculated.

(FZG Gear Wheel Test)

The anti-seizure ability of the composition was measured in accordance with DIN 51354 with the type A gear wheel at the oil temperature of 90° C. The test was sequentially performed from the lowest load stage of the predetermined 12 stages, and finished when seizure occurred. Evaluations were expressed in terms of the stage on which the seizure occurred. That is, the higher stage means higher anti-seizure ability. For example, the poorest anti-seizure ability is expressed as "stage 1", whereas no-seizure on all of 12 stages is expressed as "more than stage 12".

(Shell High-Speed Four Ball Test)

The anti-wear ability was evaluated by measuring wear scar diameter of the steel balls in accordance with ASTM D4172, with rotation speed of 1200 rpm, load of 40 kgf, test time of 1 hour, and at the oil temperature that equals to room temperature.

Examples 1 to 26

Mineral oils or synthetic oils, and additives were mixed at the composition ratio shown in Tables 1 and 2, to prepare the transmission oil compositions for the automobile of the present invention. The measurements of the volume resistivity and the kinematic viscosity, the FZG gear wheel test and the shell high-speed four ball test were performed as to these compositions. The results are shown in Tables 1 and 2.

An ordinary automatic transmission oil (ATF) (Comparative Example 6) having excellent lubricity as a transmission oil exhibits seizure stage of 9 in the FZG gear wheel test. Therefore, it is construed that the anti-seizure ability of stage 9 or higher is sufficient as the present composition. Further, a transmission oil has sufficient anti-wear ability if the wear scar diameter is 0.5 mm or less in the result of the shell high-speed test, and ordinary automatic transmission oils (ATF) (Comparative Examples 6 and 7) having very excellent anti-wear ability exhibit wear scar diameter of 0.4 mm or less in the shell high-speed four ball test. Therefore, it is construed that a transmission oil has very excellent anti-wear ability if the oil results in the similar results to that of ATF.

TABLE 1

| | Examples | | | | | | | | | | | | | | |
|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 |
| Base oil (% by mass) | | | | | | | | | | | | | | | |
| Mineral oil 1(1) | 50 | 50 | 50 | 50 | — | — | 50 | 50 | 50 | 50 | 50 | 50 | 50 | 50 | 50 |
| Mineral oil 2(2) | 50 | 50 | 50 | 50 | 50 | — | 50 | 50 | 50 | 50 | 50 | 50 | 50 | 50 | 50 |
| Mineral oil 3(3) | — | — | — | — | 50 | — | — | — | — | — | — | — | — | — | — |
| Mineral oil 4(4) | — | — | — | — | — | 100 | — | — | — | — | — | — | — | — | — |
| Additives (% by mass) | | | | | | | | | | | | | | | |
| (A)Zinc dialkyldithiophosphate(5) | 0.9 | 1.8 | 3.6 | 10 | 1.8 | 1.8 | — | — | — | — | — | 1.8 | 1.8 | — | 1.8 |
| (A)Zinc dialkyldithiophosphate(8) | — | — | — | — | — | — | 1.8 | — | — | — | — | — | — | — | — |
| (B)Tri(propylphenyl) phosphate | — | — | — | — | — | — | — | 0.2 | 0.6 | — | — | 0.4 | — | 0.4 | 0.4 |
| (C)Tricresyl thiophosphate | — | — | — | — | — | — | — | — | — | 0.6 | 1 | — | 0.6 | 0.6 | 0.6 |
| Other additives(7) (% by mass) | 1.5 | 1.5 | 1.5 | 1.5 | 1.5 | 1.5 | 1.5 | 1.5 | 1.5 | 1.5 | 1.5 | 1.5 | 1.5 | 1.5 | 1.5 |
| Test results | | | | | | | | | | | | | | | |
| Volume resistivity (ohm · m; 80° C.) | $2.6 \times 10^9$ | $2.6 \times 10^9$ | $1.4 \times 10^9$ | $1.3 \times 10^8$ | $2.2 \times 10^9$ | $5.1 \times 10^9$ | $2.1 \times 10^8$ | $9.2 \times 10^9$ | $4.3 \times 10^9$ | $4.7 \times 10^9$ | $2.1 \times 10^9$ | $2.5 \times 10^9$ | $2.8 \times 10^8$ | $3.9 \times 10^8$ | $2.3 \times 10^9$ |
| Kinematic viscosity ($mm^2/s$; 80° C.) | 2.5 | 2.5 | 2.5 | 2.5 | 5 | 10 | 2.5 | 2.5 | 2.5 | 2.5 | 2.5 | 2.5 | 2.6 | 2.5 | 2.6 |
| FZG gear wheel test (Stage; DIN51354 method) | 11 | 11 | 11 | 12 | 12 | 12 | 10 | 9 | 11 | 9 | 10 | 11 | 11 | 10 | 11 |
| Shell four ball wear test (mm) | 0.90 | 070 | 0.90 | 0.80 | 0.68 | 0.68 | 0.70 | 0.62 | 0.41 | 0.44 | 0.45 | 0.46 | 0.46 | 0.50 | 0.50 |

In Tables 1 to 3, mass percentage of the base oil refers to the ratio of each base oil component per the total amount of the base oil. Other mass percentages refer to the ratio of each component per the total amount of the composition. In Table 1, each of notes (1) to (7) means the following:

Note (1): Kinematic viscosity (40° C.): 3.3 $mm^2/s$

Note (2): Kinematic viscosity (80° C.): 3.8 $mm^2/s$, viscosity index: 110

Note (3): Kinematic viscosity (80° C.): 5.9 $mm^2/s$, viscosity index: 120

Note (4): Kinematic viscosity (80° C.): 10.2 $mm^2/s$, viscosity index: 130

Note (5): Alkyl group: primary octyl group

Note (6): Alkyl group: secondary butyl group and secondary hexyl group

Note (7): Containing amine antioxidant, benzotriazol, polymethacrylate, and dimethylsilicon Note (10): Boron-modified compound of polybutenyl succinimide (number average molecular weight of the polybutenyl group: 1000) (boron content: 2.0% by mass, nitrogen content: 2.3% by mass)

Note (11): Boron-modified compound of polybutenyl succinimide (number average molecular weight of the polybutenyl group: 1000) (boron content: 0.9% by mass, nitrogen content: 1.6% by mass)

Note (12): Boron-modified compound of polybutenyl succinimide (number average molecular weight of the polybutenyl group: 1000) (boron content: 0.4% by mass, nitrogen content: 1.8% by mass)

Note (13): Containing amine antioxidant, benzotriazol, polymethacrylate, and dimethylsilicon

TABLE 2

| | Examples | | | | | | | | | | |
|---|---|---|---|---|---|---|---|---|---|---|---|
| | 16 | 17 | 18 | 19 | 20 | 21 | 22 | 23 | 24 | 25 | 26 |
| Base oil (% by mass) | | | | | | | | | | | |
| Mineral oil 1(1) | 50 | 50 | 50 | 50 | 50 | 50 | 50 | 50 | | | |
| Mineral oil 2(2) | 50 | 50 | 50 | 50 | 50 | 50 | 50 | 50 | | | |
| Synthetic oil 1(3) | | | | | | | | | 100 | | |
| Synthetic oil 2(4) | | | | | | | | | | 100 | |
| Synthetic oil 3(5) | | | | | | | | | | | 100 |
| Additives (% by mass) | | | | | | | | | | | |
| (A)Zinc dialkyldithiophosphate(6) | 1.8 | 1.8 | 1.8 | 1.8 | 1.8 | 1.8 | 1.8 | — | 1.8 | 1.8 | 1.8 |
| (B)Tri(propylphenyl) phosphate | — | — | — | — | — | — | — | 0.6 | — | — | — |
| (C)Tricresyl thiophosphate | — | — | — | — | — | — | — | — | — | — | — |
| (D)Ashless dispersant 1(7) | 0.1 | — | — | — | — | — | — | — | — | — | — |
| (D)Ashless dispersant 2(8) | — | 0.5 | 1.0 | — | — | — | — | 0.5 | 0.5 | 0.5 | 0.5 |
| (D)Ashless dispersant 3(9) | — | — | — | 0.6 | — | — | — | — | — | — | — |
| (D)Boron containing ashless dispersant 1(10) | — | — | — | — | 0.6 | — | — | — | — | — | — |
| (D)Boron containing ashless dispersant 2(11) | — | — | — | — | — | 0.5 | — | — | — | — | — |
| (D)Boron containing ashless dispersant 3(12) | — | — | — | — | — | — | 1.2 | — | — | — | — |
| Amount of nitrogen due to (D) (ppm by mass) | 30 | 100 | 200 | 50 | 140 | 80 | 220 | 100 | 100 | 100 | 100 |
| Other additives(13) | 1.5 | 1.5 | 1.5 | 1.5 | 1.5 | 1.5 | 1.5 | 1.5 | 1.5 | 1.5 | 1.5 |
| Test results | | | | | | | | | | | |
| Volume resistivity (ohm · m; 80° C.) | $2.6 \times 10^9$ | $2.6 \times 10^9$ | $2.2 \times 10^8$ | $3.4 \times 10^8$ | $4.3 \times 10^9$ | $2.2 \times 10^9$ | $3.4 \times 10^8$ | $4.3 \times 10^9$ | $2.1 \times 10^8$ | $2.4 \times 10^8$ | $1.3 \times 10^9$ |
| Kinematic viscosity ($mm^2/s$; 80° C.) | 2.5 | 2.5 | 2.5 | 2.5 | 2.5 | 2.5 | 2.5 | 2.5 | 2.4 | 3.0 | 3.0 |
| FZG gear wheel test (Stage; DIN51354 method) | 11 | 11 | 11 | 11 | 11 | 11 | 11 | 11 | 10 | 10 | 10 |
| Shell four ball wear test (mm) | 0.38 | 0.37 | 0.36 | 0.36 | 0.36 | 0.36 | 0.38 | 0.38 | 0.41 | 0.42 | 0.41 |

In Table 2, each of notes (1) to (13) means the following:

Note (1): Kinematic viscosity (40° C.): 3.3 $mm^2/s$

Note (2): Kinematic viscosity (80° C.): 3.8 $mm^2/s$, viscosity index: 110

Note (3): 1-decene oligomer hydride, kinematic viscosity (80° C.): 2.5 $mm^2/s$, viscosity index: 125

Note (4): Neopentyl glycol 2-ethylhexanoate, kinematic viscosity (80° C.): 2.9 $mm^2/s$, viscosity index: 61

Note (5): Alkylbenzene, kinematic viscosity (80° C.): 3.0 $mm^2/s$, viscosity index: 19

Note (6): Alkyl group: primary octyl group

Note (7): Polybutenyl succinimide (number average molecular weight of the polybutenyl group: 300, nitrogen content: 3.0% by mass)

Note (8): Polybutenyl succinimide (number average molecular weight of the polybutenyl group: 1000, nitrogen content: 2.0% by mass)

Note (9): Polybutenyl succinimide (number average molecular weight of the polybutenyl group: 3000, nitrogen content: 0.9% by mass)

As obvious from Tables 1 and 2, the composition of the present invention has the volume resistivity of $1\times10^7$ ohm·m at 80° C., i.e., having excellent insulating ability, and resulted in the seizure stage of 9 or higher in the FZG gear wheel test, i.e., exhibiting excellent anti-seizure ability. Even the transmission oil compositions having higher cooling ability, that are the compositions having as low viscosity as 1.5 to 4.0 $mm^2/s$ at 80° C. (Examples 1 to 4 and 7 to 26), exhibited sufficient anti-seizure abilities, which are excellent results. The excellent effects of the present invention were recognized as well with the cases in which, as the base oil, a poly alpha-olefin hydride, an ester compound or an alkylbenzene is employed

Examples 24 to 26

Compared to the compositions containing only the component (A) as the phosphate compound (Examples 1 to 7), the compositions each containing the component(s) (B) and/or (C), or the compositions each containing both the component (A) and the component (B) and/or (C) in combination (Examples 8 to 15) were found out to have even more excellent anti-wear ability.

It is also found out that the composition obtains very excellent anti-wear ability if the composition further contains the ashless dispersant (D). Particularly, when the component (D) was co-used with the component (A), excellent effect of the co-use was recognized, i.e., the wear scar diameter was reduced to less than a half.

By suitably selecting the base oil, the components (A) to (D), other components, and ratio thereof, it is possible to obtain the composition having high insulating ability, i.e. the volume resistivity at 80° C. of $5\times10^8$ ohm·m or more, and particularly $1\times10^9$ ohm·m or more, high anti-seizure ability, in addition to high cooling ability and high anti-wear ability, (Examples 1 to 3, 5 to 21, 23, 24 and 26).

Comparative Examples 1 to 5

Transmission oil compositions for an automobile were produced in the same way as in Examples 1 to 26 except that the content of the mineral oils and the additives were as shown in Table 3. Measurement of the volume resistivity and kinematic viscosity, the FZG gear wheel test, and the shell high-speed four ball test were performed as to each composition. The results are shown in Table 3.

Although the volume resistivity at 80° C. was as high as $1\times10^7$ ohm·m or more, i.e. had high insulating ability, with the cases in which the content of the components (A) to (C) was lower than that defined in the present invention (Comparative Examples 1 to 3), any of them had poor anti-seizure ability and therefore were unable to give a sufficient lubricity to the gears and bearings. With the cases in which a phosphite compound (a phosphite diester) was employed in place of the component (B) (Comparative Examples 4 and 5), seizure occurred at the stage 8 in the FZG gear wheel test, i.e. the anti-seizure ability thereof was insufficient.

Comparative Examples 6 to 10

Measurements of the volume resistivity and kinematic viscosity (Comparative Examples 6 to 10), as well as the FZG gear wheel test (Comparative Examples 6, 8 and 10) and the high-speed four ball test (Comparative Examples 6, 7 and 10) were performed as to ordinary ATFs, gear oils and an insulating oil. The results are shown in Table 3. All of such ordinary ATFs and gear oils (Comparative Examples 6 to 9) resulted in low volume resistivity at 80° C., i.e. insufficient insulating ability. Although the insulating oil (Comparative Example 10) exhibited high volume resistivity at 80° C., it exhibited very poor anti-seizure ability, and resulted in seizure in the high-speed four ball test, i.e., it had extremely poor anti-wear ability.

TABLE 3

| | Comparative Examples | | | | | | | | | |
|---|---|---|---|---|---|---|---|---|---|---|
| | 1 | 2 | 3 | 4 | 5 | 6 | 7 | 8 | 9 | 10 |
| Base oil (% by mass) | | | | | | Ordinary ash-free ATF | Ordinary metal ATF | Ordinary SP gear oil | Ordinary Zn—Ca gear oil | Ordinary insulating oil |
| Mineral oil 1(1) | 50 | 50 | 50 | 50 | 50 | | | | | |
| Mineral oil 2(2) | 50 | 50 | 50 | 50 | 50 | | | | | |
| Mineral oil 3(3) | — | — | — | — | — | | | | | |
| Mineral oil 4(4) | — | — | — | — | — | | | | | |
| Additives (% by mass) | | | | | | | | | | |
| (A)Zinc dialkyldithiophosphate(5) | 0.05 | — | — | — | — | | | | | |
| (B)Tri(propylphenyl) phosphate | — | 0.05 | — | — | — | | | | | |
| (C)Tricresyl thiophosphate | — | — | 0.05 | — | — | | | | | |
| Diphenyl phosphite | — | — | — | 0.6 | — | | | | | |
| Dibutyl phosphite | — | — | — | — | 0.6 | | | | | |
| Other additives(7) (% by mass) | 1.5 | 1.5 | 1.5 | 1.5 | 1.5 | | | | | |
| Test results | | | | | | | | | | |
| Volume resistivity (ohm · m; 80° C.) | $4.0\times10^{10}$ | $9.2\times10^{10}$ | $7.7\times10^{10}$ | $2.4\times10^{8}$ | $9.4\times10^{7}$ | $2.8\times10^{8}$ | $5.8\times10^{6}$ | $5.1\times10^{5}$ | $2.6\times10^{5}$ | $1.0\times10^{12}$ |
| Kinematic viscosity ($mm^2/s$; 80° C.) | 2.5 | 2.5 | 2.5 | 2.5 | 2.5 | 11.1 | 10.9 | 39.1 | 37.5 | 2.6 |
| FZG gear wheel test (Stage; DIN51354 method) | 5 | 4 | 3 | 8 | 8 | 9 | — | more than 12 | — | 2 |
| Shell four ball wear test (mm) | — | — | — | — | — | 0.36 | 0.38 | — | — | Seizure |

In Table 3, each of notes (1) to (7) means the following:

Note (1): Kinematic viscosity (40° C.): 3.3 $mm^2/s$

Note (2): Kinematic viscosity (80° C.): 3.8 $mm^2/s$, viscosity index: 110

Note (3): Kinematic viscosity (80° C.): 5.9 $mm^2/s$, viscosity index: 120

Note (4): Kinematic viscosity (80° C.): 10.2 $mm^2/s$, viscosity index: 130

Note (5): Alkyl group: primary octyl group

Note (6): Alkyl group: secondary butyl group and secondary hexyl group

Note (7): Containing amine antioxidant, benzotriazol, polymethacrylate, and dimethylsilicon

What is claimed is:

1. A transmission oil composition for an automobile comprising:

a base oil consisting essentially of a mineral oil having a kinematic viscosity at 80° C. of 1.5 to 15 $mm^2/s$ and a viscosity index of 80 or more, and a mineral oil having a kinematic viscosity at 40° C. of 1.0 to 6.0 $mm^2/s$, and a phosphate compound selected from the group consisting of (A) a zinc dithiophosphate having a hydrocarbon group, (B) a triaryl phosphate, (C) a triaryl thiophosphate, and mixtures thereof at 0.1 to 15.0% by mass with respect to the total composition, wherein said composition has a volume resistivity of $1\times10^7$ ohm·m or more at 80° C., and wherein the kinematic viscosity of said composition at 80° C. is 1.5 to 4.0 $mm^2/s$.

2. The transmission oil composition for the automobile of claim 1, wherein said composition contains 10 to 90% by mass of said mineral oil having a kinematic viscosity at 40° C. of 1.0 to 6.0 $mm^2/s$.

3. The transmission oil composition for the automobile of claim 1 requisitely comprising as said phosphate compound a phosphate compound selected from the group consisting of (B) a triaryl phosphate, (C) a triaryl thiophosphate, and mixtures thereof.

4. The transmission oil composition for the automobile of claim 1 requisitely comprising as said phosphate compound a phosphate compound selected from the group consisting of (A) a zinc dithiophosphate having a hydrocarbon group, (C) a triaryl thiophosphate, and mixtures thereof.

5. The transmission oil composition for the automobile of claim 1 further comprising (D) an ashless dispersant.

6. The transmission oil composition for the automobile of claim 1 wherein the volume resistivity of said composition at 80° C. is $5\times10^8$ ohm·m or more.

7. The transmission oil composition for the automobile of claim 1 wherein said composition is an oil for a transmission system, an oil for both the transmission system and an electric motor, or an oil for a device in which the transmission system and the electric motor share a common lubrication system in an electric vehicle or a hybrid vehicle.

* * * * *